US007431387B2

(12) United States Patent
LaPointe et al.

(10) Patent No.: US 7,431,387 B2
(45) Date of Patent: Oct. 7, 2008

(54) ADJUSTABLE TOGGLE AND STOP FOR A FURNITURE MECHANISM

(75) Inventors: Larry P LaPointe, Temperance, MI (US); Richard D Hartford, Maybee, MI (US)

(73) Assignee: La-Z-Boy Incorporated, Monroe, MI (US)

( * ) Notice: Subject to any disclaimer, the term of this patent is extended or adjusted under 35 U.S.C. 154(b) by 604 days.

(21) Appl. No.: 11/111,124

(22) Filed: Apr. 21, 2005

(65) Prior Publication Data

US 2006/0249992 A1 Nov. 9, 2006

(51) Int. Cl.
*A47C 1/02* (2006.01)

(52) U.S. Cl. ..... 297/68; 297/69; 297/85; 297/423.19; 297/303.4

(58) Field of Classification Search ..... 297/69, 297/423.19, 303.4, 85, 68, 83
See application file for complete search history.

(56) References Cited

U.S. PATENT DOCUMENTS 4,362,335 A * 12/1982 Drabert et al. ..... 297/300.3
5,323,526 A * 6/1994 Saul et al. ..... 29/436
5,328,235 A 7/1994 Saul et al.
5,527,095 A 6/1996 Marshall et al.
5,806,921 A 9/1998 LaPointe et al.
5,975,627 A * 11/1999 LaPointe et al. ..... 297/68
6,409,262 B1 6/2002 LaPointe
6,655,732 B1 12/2003 LaPointe
6,893,085 B2 * 5/2005 LaPointe et al. ..... 297/85
6,988,769 B2 * 1/2006 LaPointe ..... 297/85
2003/0071502 A1 4/2003 Marshall et al.

* cited by examiner

*Primary Examiner*—Laurie K Cranmer
(74) *Attorney, Agent, or Firm*—Harness, Dickey & Pierce, P.L.C.

(57) ABSTRACT

A biasing element assembly for an article of furniture includes an actuation mechanism to enable a leg rest assembly to move between a stowed position and an extended position and be retained in intermediate positions. The mechanism includes a support shaft, a drive rod spaced apart from the support shaft, and a toggle link coupled to the drive shaft. Multiple apertures are aligned on the toggle link. The biasing element assembly includes a single biasing element having first and second ends. The first end is connected to one of the toggle link apertures. The biasing element second end is a hook that slides along the support shaft. A biasing element spring tension is varied by engaging the first end to different ones of the toggle link apertures. The biasing element slides to align itself on the support shaft where a biasing element length is minimized.

29 Claims, 12 Drawing Sheets

FIG 10
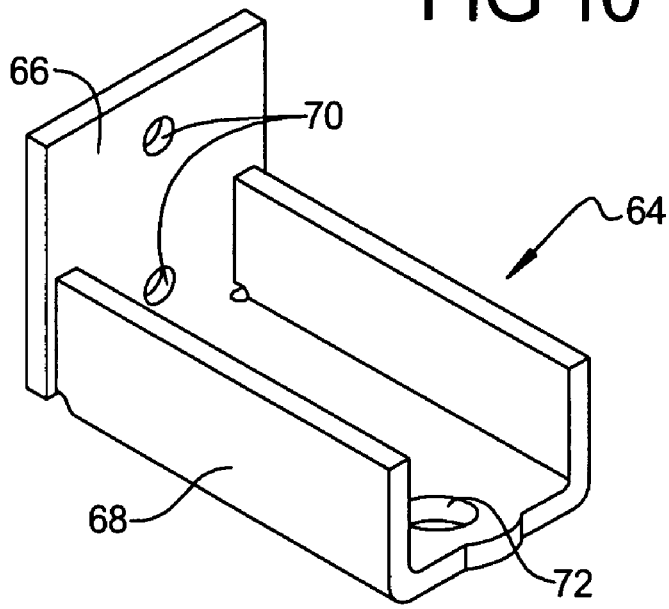
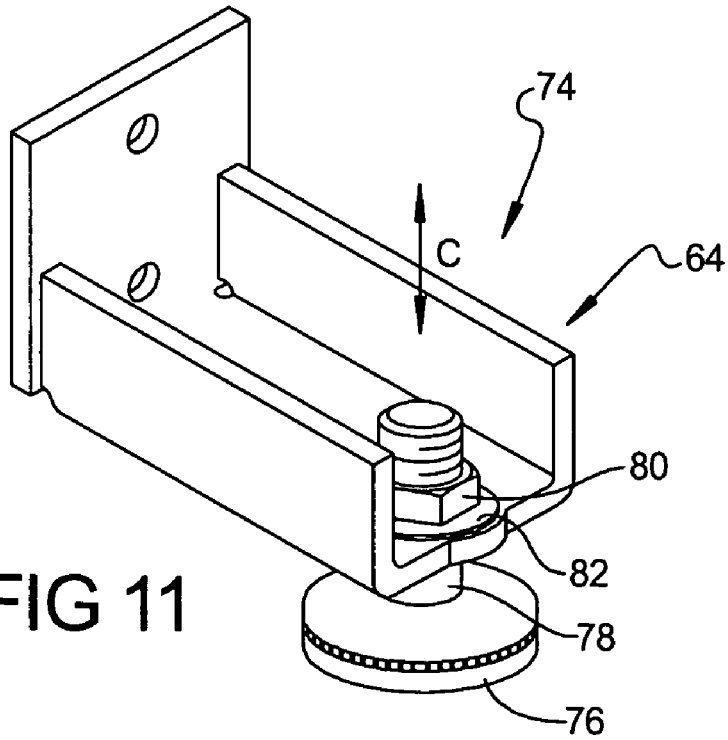
FIG 11

FIG 12
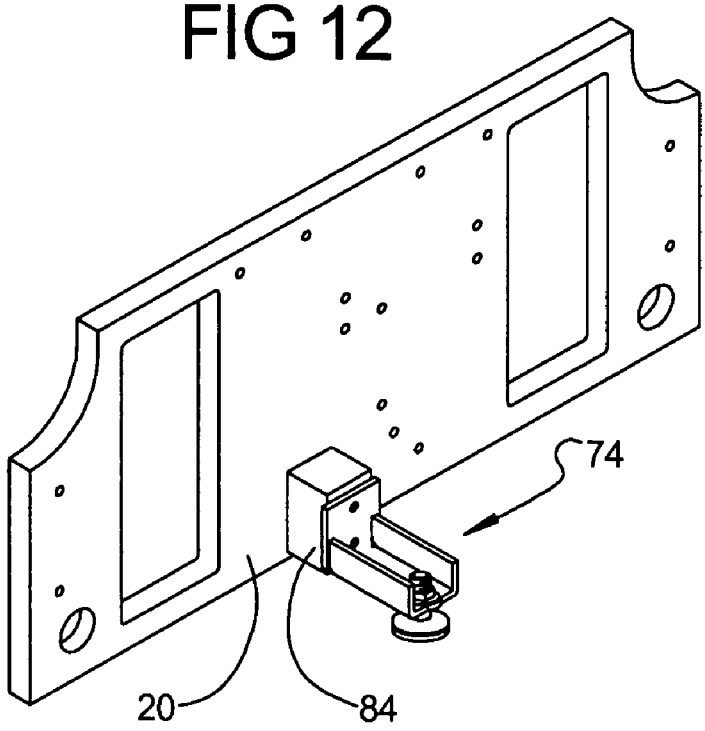
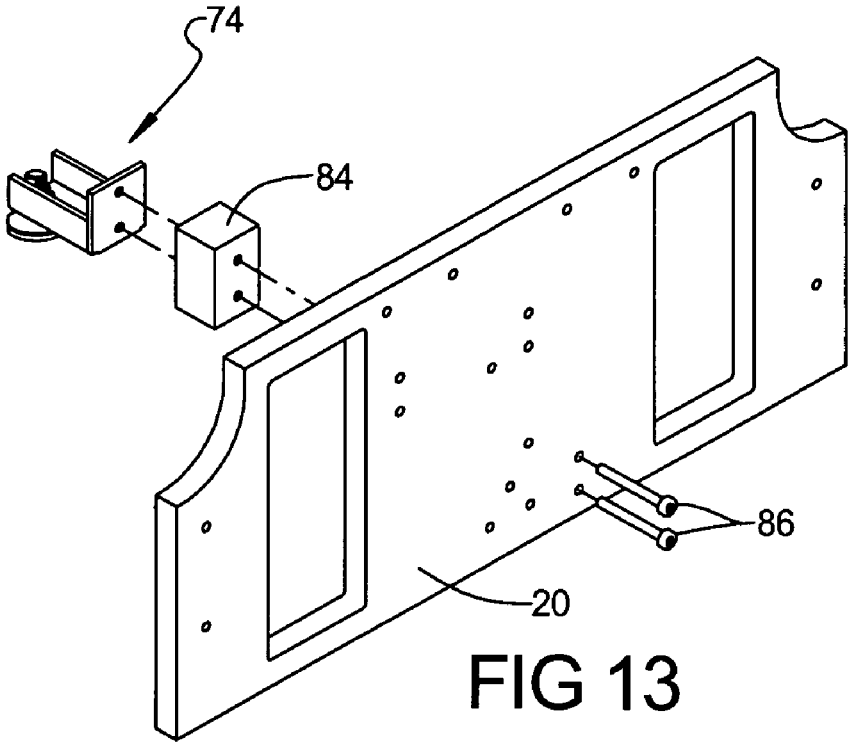
FIG 13

ADJUSTABLE TOGGLE AND STOP FOR A FURNITURE MECHANISM

FIELD OF THE INVENTION

The present invention relates in general to furniture and, more particularly to an adjustable feature for a leg rest extension mechanism for articles of furniture such as chairs, sofas, and loveseats.

BACKGROUND OF THE INVENTION

Conventionally, reclining type articles of furniture (i.e., chairs, sofas, loveseats, and the like) require a mechanism to bias a leg rest assembly in the extended and stowed positions. Known mechanisms commonly include a large number of moving parts that tends to increase the manufacturing time and costs associated with the furniture.

Moreover, because these parts move to extend and stow the leg rest assembly the parts require alignment relative to one another to ensure proper operation. Additionally, the large number of parts adds weight to the furniture thereby making the furniture difficult to move and transport. Additionally, the occupant of the seat must overcome the biasing force to begin extending the leg rest assembly. Since one of the purposes of providing the leg rest assembly is to increase user comfort, overcoming a large biasing force tends to detract from the user's enjoyment of the furniture.

Once the occupant does overcome the biasing force of the mechanism, though, the large number of moving parts tends to generate noise as the user extends (or stows) the assembly. Also, as the assembly nears its fully extended (or retraced) position, known mechanisms suddenly accelerate (or jerk) to the fully extended position. Again, these disadvantages of known mechanisms detract from the occupant's comfort and enjoyment of the furniture. The large number of parts also exposes the furniture to an increased risk of mechanical failure, particularly of those parts subject to cyclic stress (i.e., fatigue). Thus, a need exists to simplify and improve over the designs of known leg rest mechanisms.

Known leg rest mechanisms also offer multiple functional positions, which can be reached using a ratchet/pawl device which temporarily holds the leg rest at each successive position. Without proper tension applied by the leg rest mechanism, the ratchet/pawl device may not function to hold the leg rest at the desired position, resulting in leg rest downward drop. Further disadvantages of this type of leg rest mechanism occur due to drift upwards of the leg rest if the occupant shifts their legs, or lifts their legs from the partially extended leg rest.

SUMMARY OF THE INVENTION

A biasing element assembly is provided by the present invention for an article of furniture which includes an actuation mechanism to enable a leg rest assembly to move between a stowed position and an extended position. The mechanism includes a support shaft, a drive rod spaced apart from the support shaft, and a toggle link coupled to the drive shaft. Multiple apertures are aligned on the toggle link. The biasing element assembly includes a single biasing element with a first end and a second end. The first end is connected to one of the apertures of the toggle link. A biasing element spring tension is varied by selecting different ones of the apertures of the toggle link. The biasing element also includes a hook member at the second end adapted to slide along the support shaft. The biasing element slides to align itself at a position on the support shaft where a biasing element length is minimized.

In another embodiment, the present invention provides an actuation mechanism for an article of furniture having a seat assembly and a leg rest assembly. The leg rest assembly is moveable between a stowed position and an extended position. The actuation mechanism enables the movement of the leg rest assembly and includes a support shaft and a drive rod spaced apart from the support shaft. A toggle link is coupled to the drive shaft, the toggle link including an extending portion having a plurality of aligned apertures. A biasing assembly including a single biasing element with a first end is attached to a select one of the plurality of apertures of the toggle link. A second end of the biasing assembly engages the support shaft and is slidable along an axis defined by the support shaft to self-align the biasing element thereon.

In yet still another form, the present invention provides a stop member assembly operable to create a positive stop point for the leg rest assembly in the stowed position. The stop member assembly functions at a closed position of the actuation mechanism to provide a positive stop feature for a non-rocking chair. The stop member assembly includes a stop member which is threaded for adjustment. The stop member abuts a furniture frame member in the stowed position.

In another form, the present invention provides a method of assembling an article of furniture. The assembled article of furniture will have a seat assembly supported from a frame and an actuation mechanism for enabling a leg rest assembly to move between a stowed position and an extended position. The actuation mechanism includes a support shaft, a drive rod spaced apart from the support shaft, a biasing element connected to both the support shaft and the drive shaft, and a toggle link coupled to the drive shaft. The toggle link has a plurality of aligned apertures. The method includes connecting a first end of the biasing element to one of the plurality of apertures of the toggle link. The method further includes engaging a second end of the biasing element to the support shaft whereby the second end is slidable along an axis defined by the support shaft to operably align the biasing element thereon.

An adjustable toggle and stop for a furniture member of the present invention offers several advantages. The multiple apertures of the toggle permit a biasing member such as a spring to be pre-loaded in incremental steps. This permits a single biasing member to be used for multiple mechanism applications where the weight of the leg rest or material stretch varies. It also permits the spring force of a single biasing member to be adjusted for example to accommodate the differences in weight of different occupants or for maintenance of the mechanism. This helps maintain the leg rest in its fully extended position. The stop assembly provides a positive stop feature which prevents the mechanism/furniture member from rocking or moving in the stowed position.

Further areas of applicability of the present invention will become apparent from the detailed description provided hereinafter. It should be understood that the detailed description and specific examples, while indicating several preferred embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 10 is a front perspective view of a bracket of an adjustable stop assembly of the present invention;

FIG. 11 is a front perspective view of an adjustable stop assembly used in conjunction with the actuation mechanism of the present invention;

FIG. 12 is a perspective view showing an installed adjustable stop assembly of FIG. 11;

FIG. 13 is a rear exploded perspective view of an installation assembly for the adjustable stop assembly of the present invention.

DETAILED DESCRIPTION OF THE PREFERRED EMBODIMENTS

The present invention modifies the furniture mechanism disclosed in United States Utility patent application Ser. No. 10/849,995, filed May 20, 2004, entitled "FURNITURE MECHANISM", the disclosure of which is incorporated herein by reference. In addition, the present invention is also directed to a method of assembling the actuation mechanism having the adjustable toggle and adjustable stop for an article of furniture having a leg rest assembly (e.g., a recliner or the like). As will be described, the actuation mechanism contains fewer parts and is accordingly simpler, lighter, and more reliable than known actuation mechanisms. Concomitantly, the present invention facilitates application of highly efficient fabrication and assembly processes.

Figure 1:
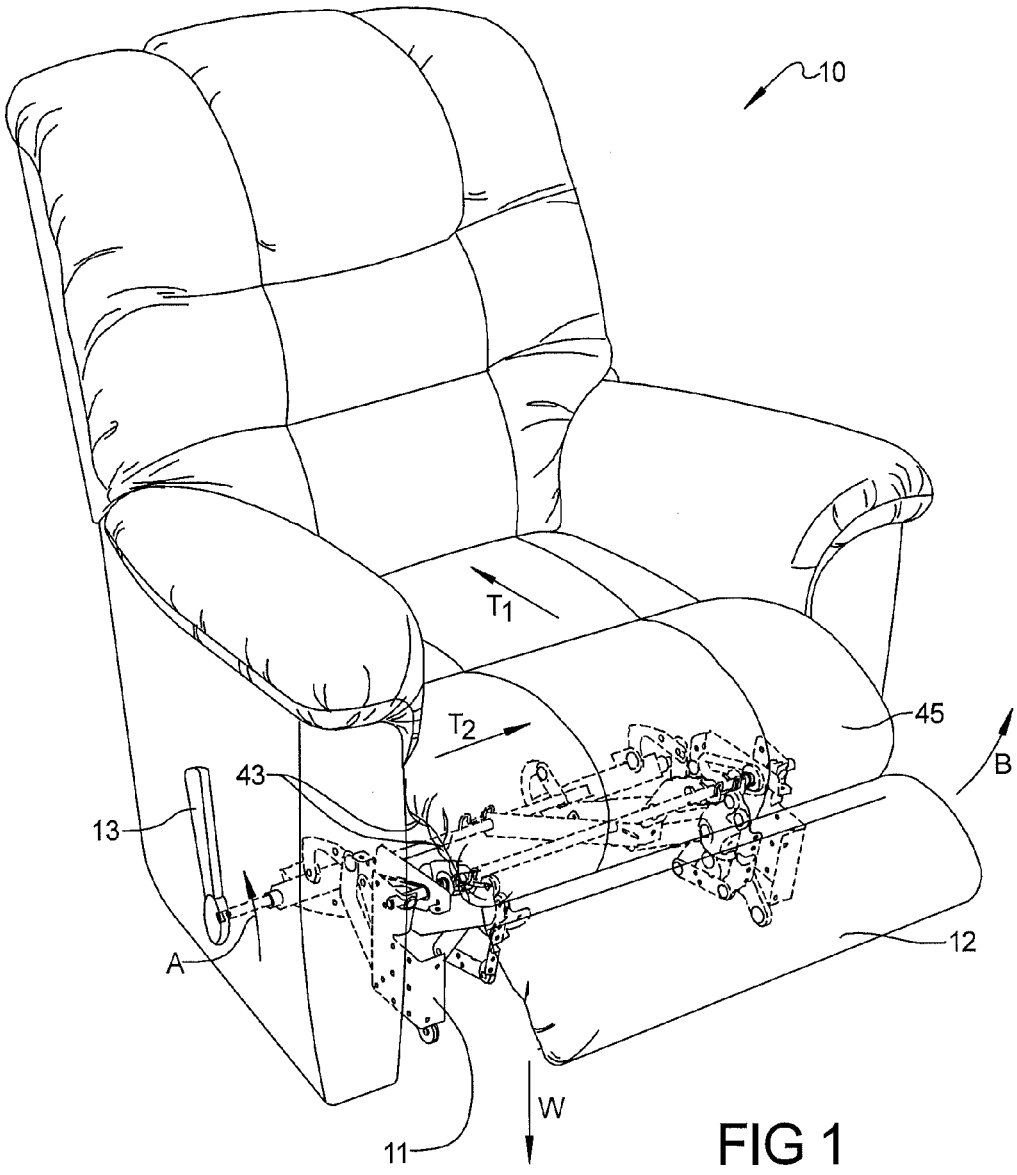
FIG. 1 is a front perspective view of a reclining chair having a furniture mechanism adjustable spring toggle of the present invention.

With particular reference now to the drawings, in accordance with the teachings of the present invention and referring generally to FIG. 1, a furniture member 10 such as a reclining chair includes an actuation mechanism 11 for use in single or multi-person furniture members 10. In the aspect shown, furniture member 10 is a reclining chair, however, the invention is not limited to reclining chairs. Furniture member 10 can be any of a plurality of furniture members, including, but not limited to chairs, sofas and/or loveseats. Furniture member 10 and actuation mechanism 11 in the Figures herein are shown representing a rocking configuration. The invention is not limited to a rocking configuration and also applies equally to a non-rocking (fixed) configuration. Actuation mechanism 11 controls the position of a leg rest 12 between a stowed position (shown in phantom) and an extended position (partially shown) by operation of a hand lever 13 in a rotation direction A. Rotation of hand lever 13 in direction A rotates leg rest 12 in a direction B. It will be apparent that rotation of hand lever 13 in an opposite direction from direction A will return the leg rest 12 to the stowed position.

Figure 2:
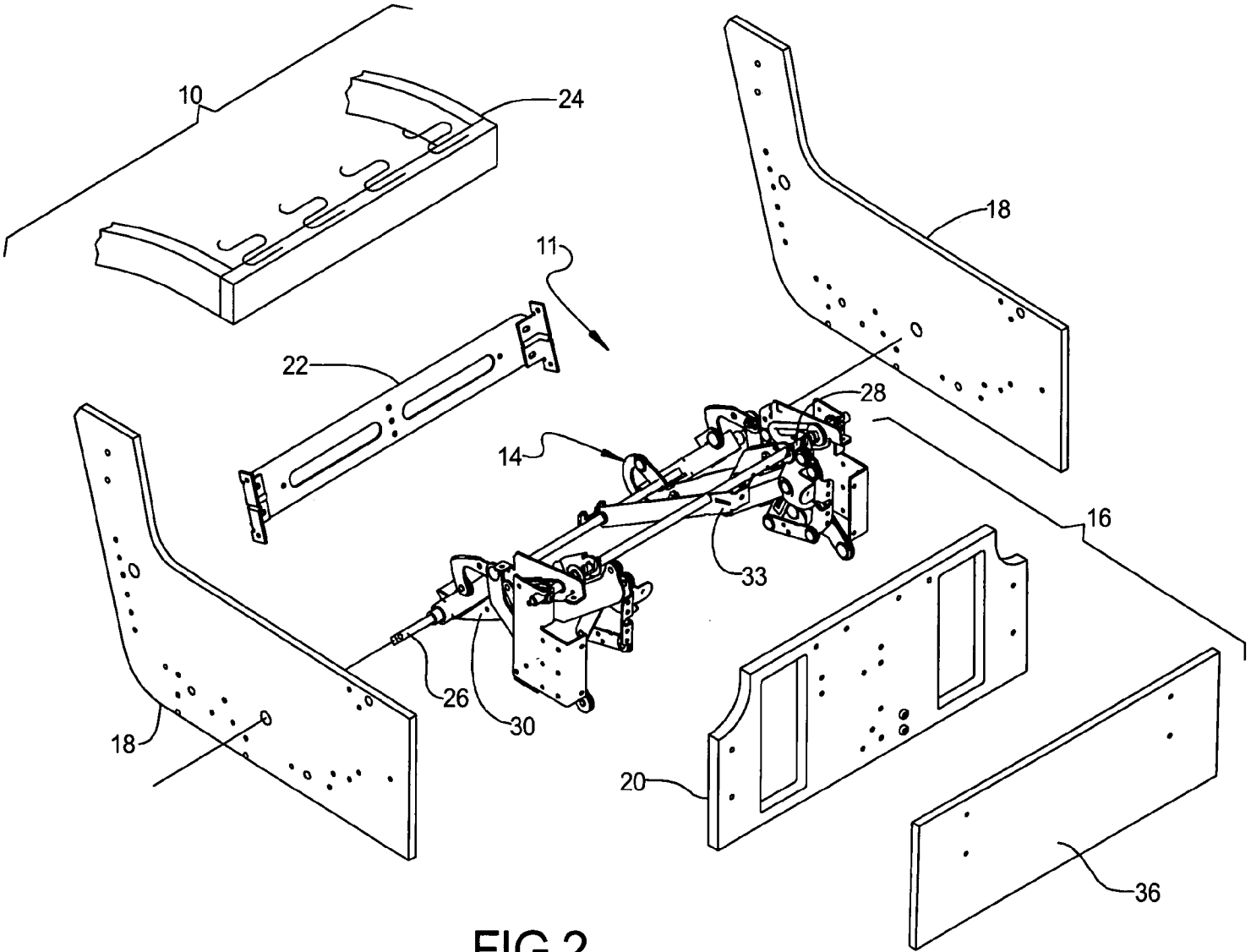
FIG. 2 is an exploded perspective view of a chair with upholstery, biasing elements and other parts removed from the pre-assembled components for illustrating the adjustable spring toggle assembly for an actuation mechanism.

Referring generally now to FIG. 2, the functional and structural aspects of actuation mechanism 11, shown operably suspended from the various pre-upholstered box-like frame components of furniture member 10 (partially shown), will now be described. Actuation mechanism 11 includes a single biasing element toggle assembly 14 to bias a leg rest assembly 16 in either of the stowed (shown) or extended positions. Moreover, single biasing element toggle assembly 14 simplifies the assembly process and improves the reliability of the actuation mechanism 11. In the disclosed embodiments, the article of furniture member 10 includes a pre-assembled actuation mechanism 11 and various upholstered frame components (not shown). Moreover, since the actuation mechanism 11 of the present invention is relatively compact in size, the use of loose upholstered cushions, which is an important feature in marketing various styles of chair, sofa or loveseat furniture, is also possible.

For purposes of clarity, FIG. 2 shows the various pre-assembled frame components with their upholstery, padding, springs, etc. removed to better illustrate the interdependency of the frame components' construction which can be rapidly and rigidly assembled in a relative easy and efficient manner. Therefore, all of the frame components can be individually fabricated or sub-assembled to include the requisite brackets, springs, padding and upholstery on an "off-line" batch-type basis. Thereafter, the various pre-assembled and upholstered frame components are assembled for totally integrating actuation mechanism 11 therein.

Figure 3:
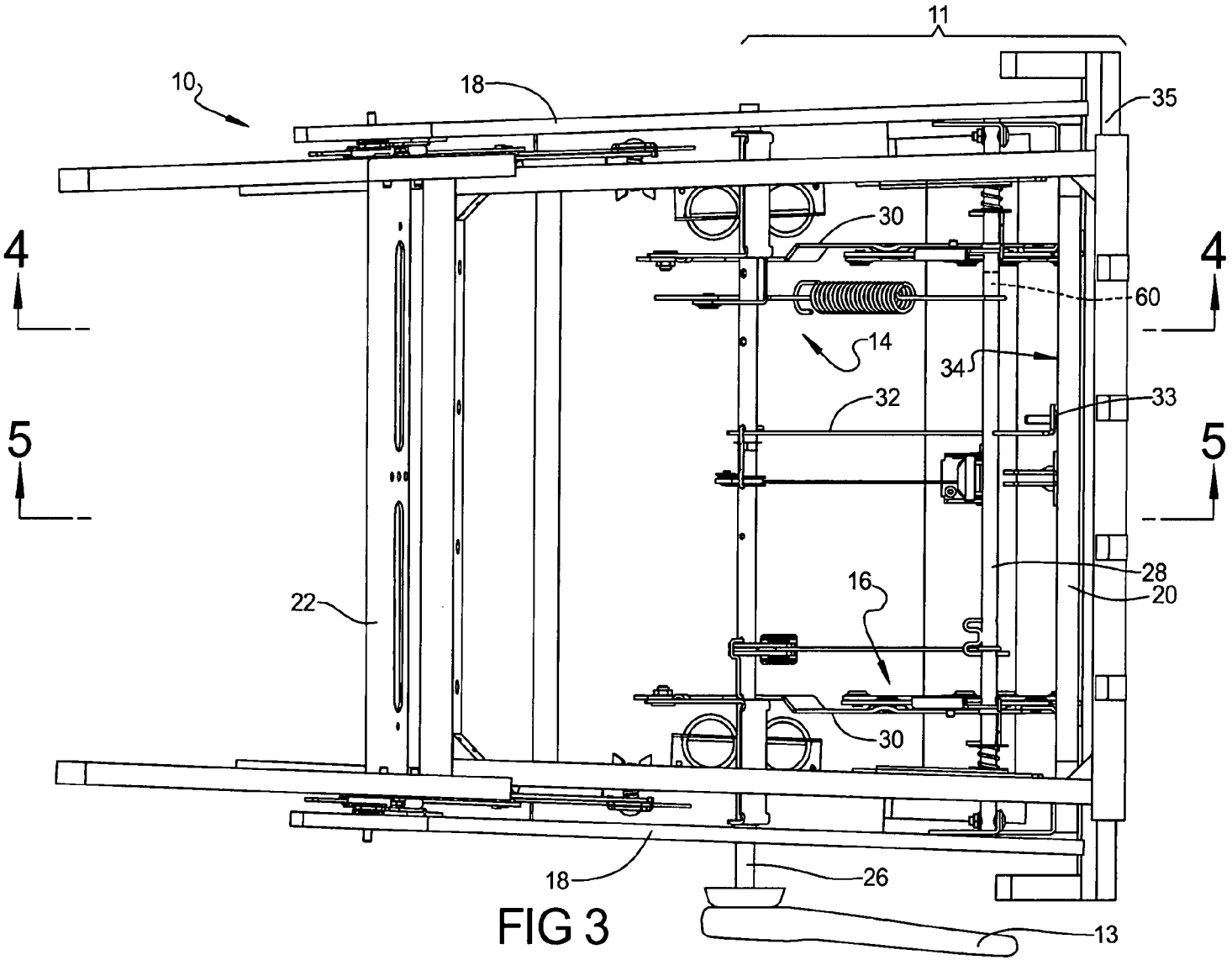
FIG. 3 is a plan view of the leg rest mechanism in accordance with a preferred embodiment of the present invention.
Figure 4:
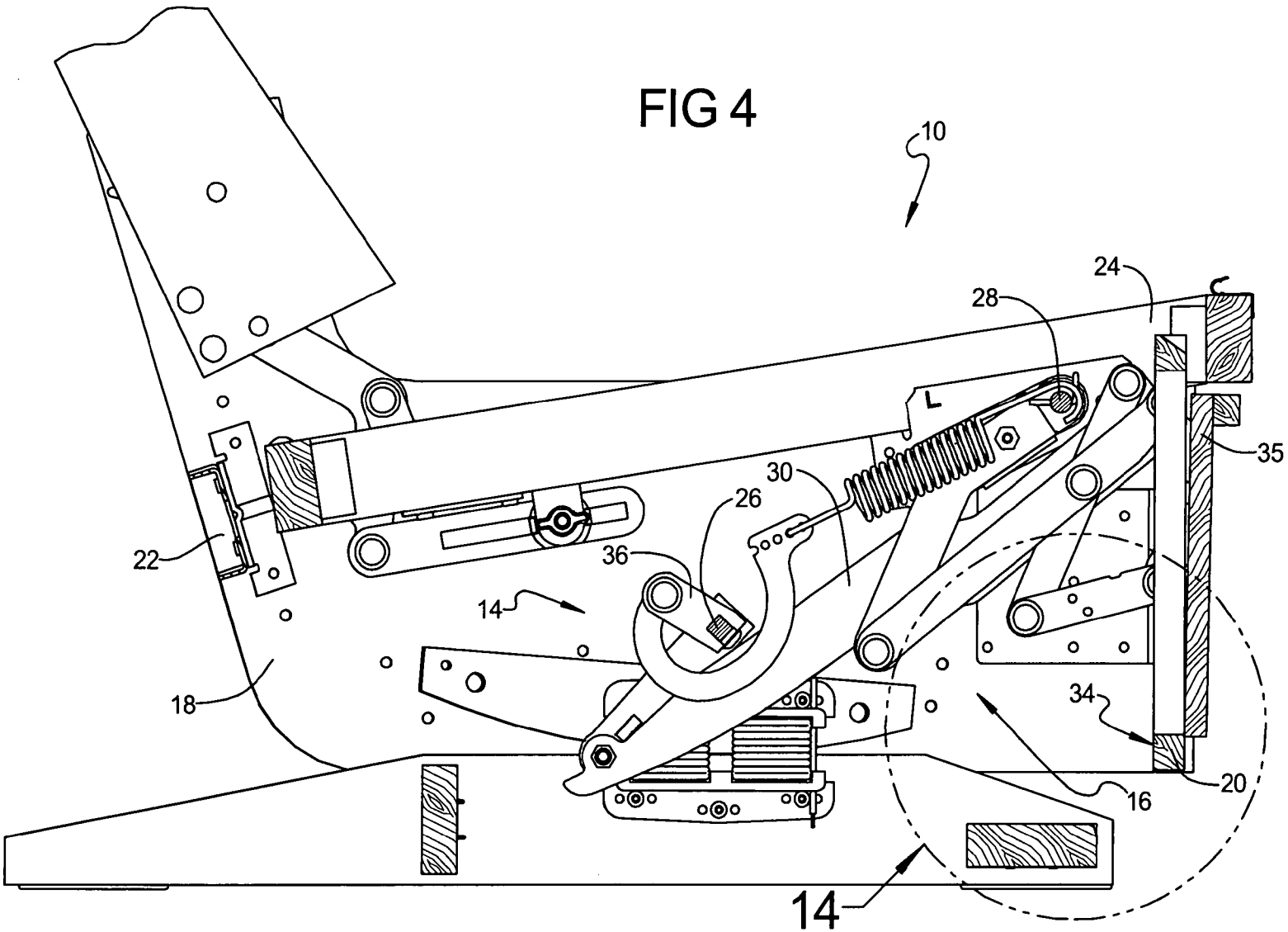
FIG. 4 is a cross sectional side elevational view taken at section 4-4 of FIG. 3.

As best seen in reference to FIGS. 2 through 4, actuation mechanism 11 of furniture member 10 is integrated into and operably suspended from left and right side frame assemblies 18. In addition to side frame assemblies 18, furniture member 10 also includes front and rear rail assemblies 20, 22, respectively, which when interconnected define a rigid "box-like" chair frame. Seat assembly 24 is supported within the side frame assemblies 18 and actuation mechanism 11. As will be described in greater detail hereinafter, actuation mechanism 11 is pre-assembled to include a drive rod 26 and front support shaft 28, both of which are spatially oriented to be "suspended" from left and right side frame assemblies 18.

Actuation mechanism 11 is shown to support leg rest assembly 16 thereon. More specifically, leg rest assembly 16 includes left and right pantograph linkages 30 and single biasing element toggle assembly 14 which is operably associated with drive rod 26 and front support shaft 28 to selectively actuate leg rest assembly 16. A rigid cross-brace 32 is secured between drive rod 26 and support shaft 28 for providing structural rigidity within actuation mechanism 11. One end of cross-brace 32 is journally supported on drive rod 26 while the opposite end thereof is configured as a bracket 33 which is fixedly secured (such as by a suitable threaded fastener) to an inner surface 34 of front rail assembly 20. Furthermore, support shaft 28 is fixed to an intermediate portion of cross-brace 32 to inhibit rotation of support shaft 28 upon rotation of drive rod 26. In one preferred construction, drive rod 26 is an elongated rectangular shaped shaft having hand lever 13 (shown in FIG. 1) provided adjacent an upholstered exterior portion of one of side frame assemblies 18 that can be easily reached by a person seated in furniture member 10 for convenient actuation thereof.

As best seen in FIG. 2, most of the structural frame components such as side frame assemblies 18, front rail assembly 20, rear rail assembly 22, seat assembly 24, and a leg rest frame board 35 are each constructed in a manner which enables them to support connecting elements, padding, upholstery, etc. in order to complete a decorative and stylish furniture member 10. Preferably, each of these frame components is fabricated from one or more wood panels and/or rails that are fixedly secured together by suitable fasteners, such as dowels, staples, nails and screws, and which may be reinforced at critical joints by metal reinforcement plates or brackets and/or wood corner blocks in a known manner. As previously noted, each frame component is individually preassembled for subsequent assembly into the furniture member 10. However, it is to be understood that the specific construction shown for each frame component is merely exemplary in nature.

Leg rest assembly 16 includes frame board 35 having an outer surface that is padded and upholstered. Frame board 35 is supported and moved by identical left and right hand pantograph linkages 30. Pantograph linkages 30 may be similar in function and structure to that shown in FIG. 3 of U.S. Pat. No. 3,096,121, assigned to the common Assignee of the present invention, with the exception that pantograph linkages 30 are operably suspended about the second set of "fixed" suspension points defined by support shaft 28.

As best seen in FIGS. 3-4, single biasing element toggle assembly 14 works coactively with leg rest pantograph linkages 30. Toggle assembly 14 allows for securely holding frame board 35 of leg rest assembly 16 in a fully retracted position against front rail assembly 20. Toggle assembly 14 is also operable to supply a spring force for biasingly urging leg rest assembly 16 toward one of its extended and retracted positions. More particularly, toggle assembly 14 includes a substantially L-shaped toggle lever 36 which receives square drive rod 26 for rotation therewith.

Referring now generally to FIG. 5 and again to FIG. 1, a ratchet 37 is mounted to inner surface 34 of front rail assembly 20. A pawl 38 is moved from a non-engaged position shown to an engaged position with the teeth of ratchet 37 by a linkage assembly 39 which responds to rotation of drive rod 26 to position pawl 38 into operable contact with ratchet 37. Ratchet 37 and pawl 38 provide multiple "stepped" positions for frame board 35 and leg rest assembly 16. Premature downward "drop" or upward "drift" of the leg rest of commonly known leg rest assemblies is eliminated by using an adjustable element of biasing element toggle assembly 14 of the present invention. In one preferred embodiment, leg rest assembly provides three functional stepped positions, each requiring the leg rest to remain in the stepped position and not drop down due to the leg weight of a user or drift upward if no user leg weight is applied. Multiple forces unique to each different furniture member need to be balanced to prevent leg rest drop or drift, such as a frame and a leg rest assembly weight "W", tension "$T_1$" provided by the material covering seat assembly 24, tension "$T_2$" from straps 43 used to mount pads 45 or material to seat assembly 24 and the tension "$T_3$" provided by the biasing element 52. By adjusting a spring force "F" applied to leg rest assembly 16 using biasing element toggle assembly 14 of the present invention, these conditions can be balanced.

Figure 6:
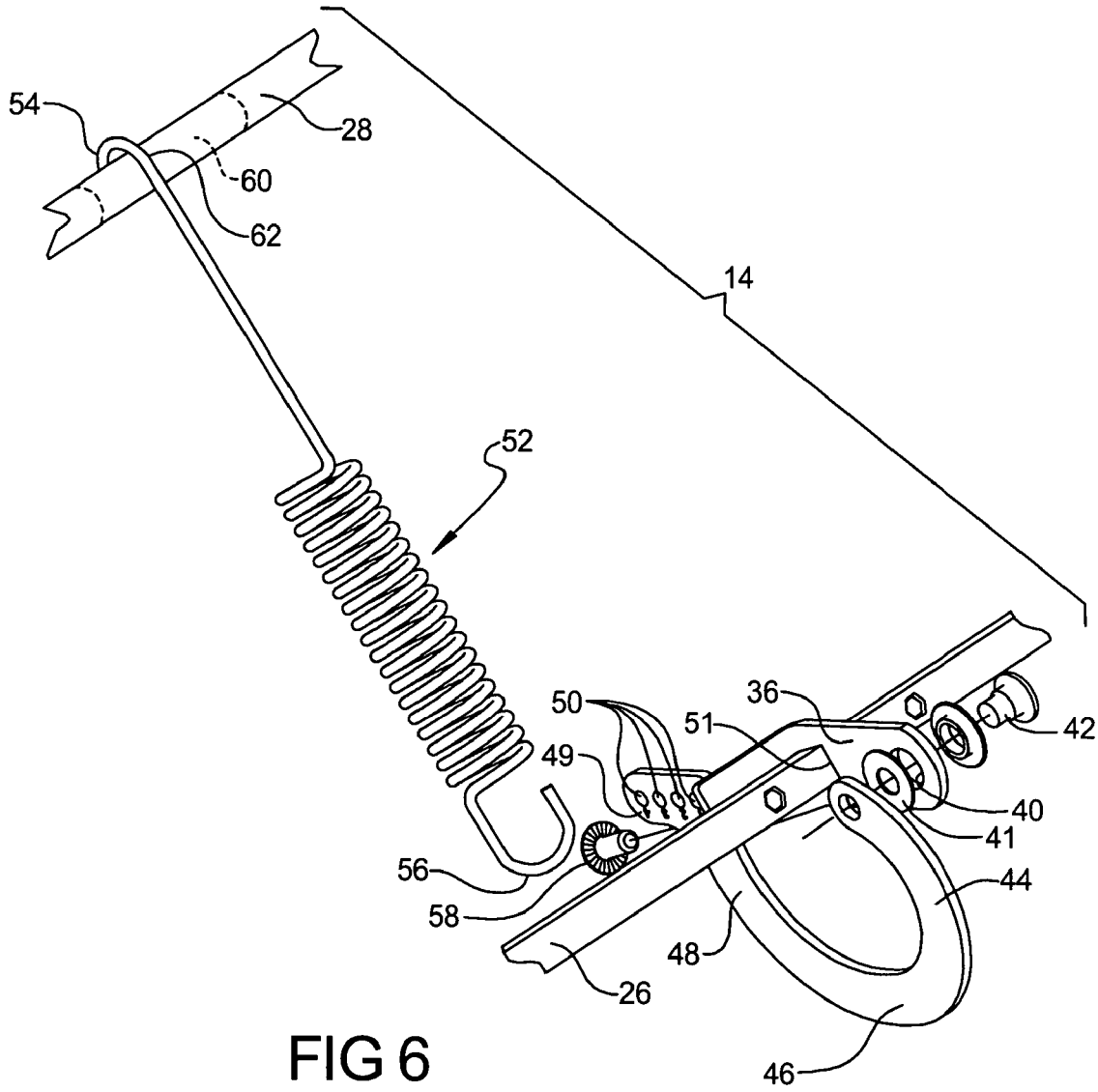
FIG. 6 is an exploded perspective view of an adjustable spring toggle assembly of the present invention.

Referring generally to FIG. 6, toggle lever 36 is pivotally connected through an aperture 40, using a washer 41 and a pivot 42 to a rear leg 44 of a substantially C-shaped adjustable toggle link 46 that curves around, below and to the rear of drive rod 26. A front leg 48 of toggle link 46 transitions into an extended arm 49. A plurality of apertures 50 are substantially co-axially aligned with each other on extended arm 49. An assembly of toggle lever 36 and toggle link 46 receives drive rod 26 through a rectangular-shaped aperture 51 of toggle lever 36. A biasing element 52, which in one aspect is configured as a helical coil spring, provides an engagement member 54 at one end and an attachment element 56 at an opposite end. Attachment element 56 in the form of a hook is received in one of the apertures 50. In one aspect, four apertures 50, 50', 50", 50'" are provided. The quantity of apertures 50 can also be increased or decreased from four without departing from the scope of the present invention. The specific aperture 50, 50', 50", 50'" is selected generally by the manufacturer, and this selectability permits a plurality of furniture member designs to use a single design of actuation mechanism 11 with a common biasing element as will be further described herein. The toggle lever 36 is positively coupled to drive rod 26 by a fastener 58 for maintaining toggle assembly 14 in place on drive rod 26. The configuration of aperture 51 of toggle lever 36 in combination with the use of fastener 58 provides an advantage of non-rotatably coupling toggle lever 36 with drive rod 26. Thus, biasing element 52 will not cause toggle lever 36 to jump as toggle assembly 14 rotates over-center.

The opposite end of biasing element 52 provides engagement member 54 that is slidably engaged with support shaft 28. More specifically, engagement member 54 is configured to couple biasing element 52 with support shaft 28 while engagement member 54 remains free to slide along an axis of the support shaft 28. Taken together, biasing element 52 having engagement member 54 and attachment element 56 at the opposite end may be referred to as a biasing assembly that can be formed as one continuous part such as by forming the biasing assembly from a suitable wire. However, the biasing assembly may also be formed of multiple components. A tension in biasing element 52 is also adjustable by relatively increasing or decreasing a length or spring constant and hence the preload force of biasing element 52.

The operation of toggle assembly 14 will now be described in detail. The location of pivot 42 above drive rod 26 and the line of action of biasing element 52 are such that in the retracted position of leg rest assembly 16, the biasing or spring force acts to hold or "retain" leg rest assembly 16. As leg rest assembly 16 is initially extended upon slight rotation of drive rod 26, pivot 42 moves down and over-center of an imaginary line between about the center of the engagement member 54 (e.g., hook) and the axis of drive rod 26. Once pivot 42 is over-center, tension loading on biasing element 52 assists in drivingly rotating drive rod 26 for extending leg rest assembly 16 as front leg 48 of adjustable toggle link 46 is pulled toward engagement member 54. In addition, biasing element 52 assists the seat occupant in pivoting hand lever 13 through the required actuation angle. In similar fashion, toggle assembly 14 is adapted to utilize the biasing force of biasing element 52 to assist in returning leg rest assembly 16 to its stowed position upon reverse rotation of drive rod 26.

Figure 7:
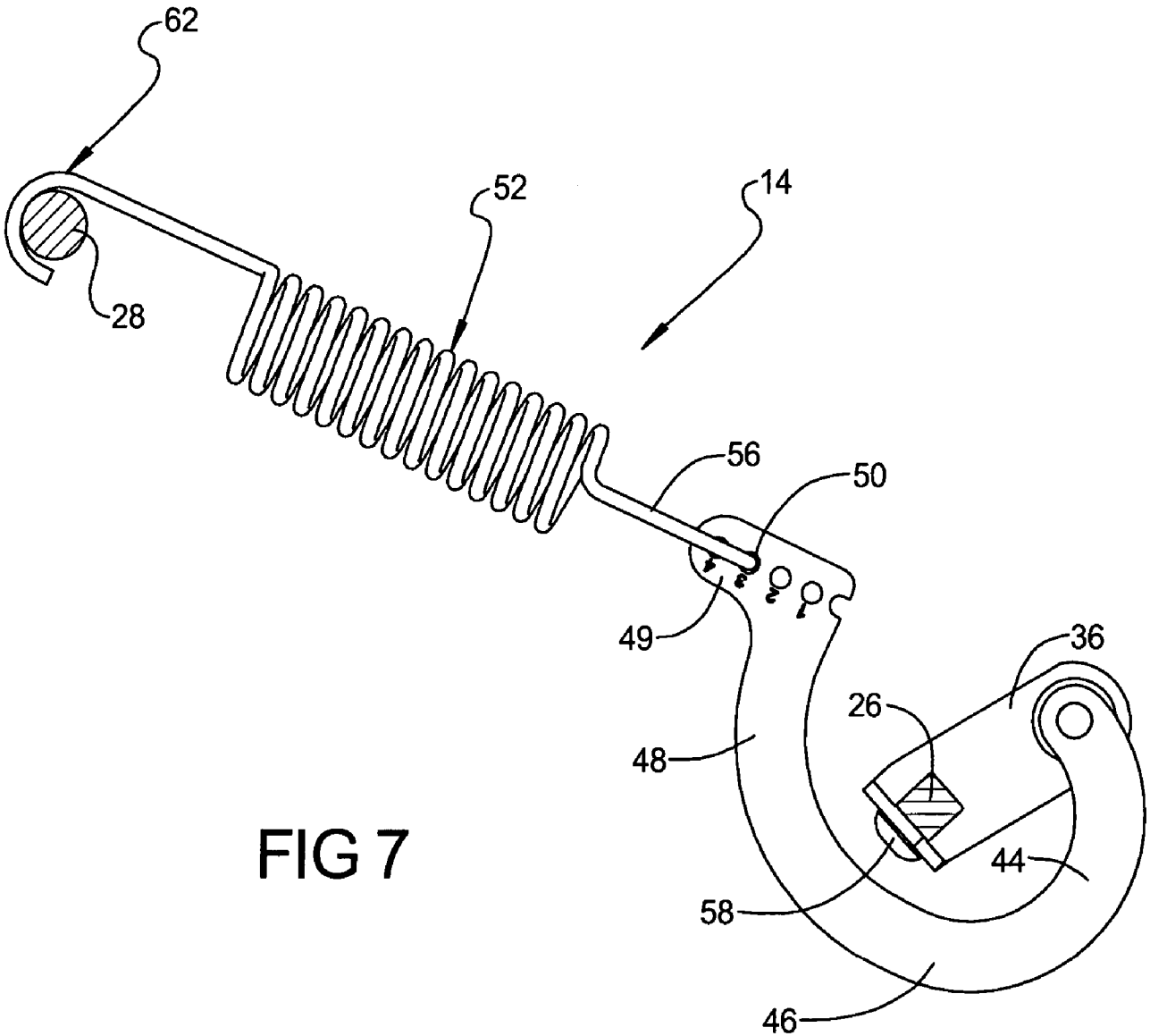
FIG. 7 is a side elevational view of the spring toggle assembly of FIG. 6 in a retracted position.
Figure 8:
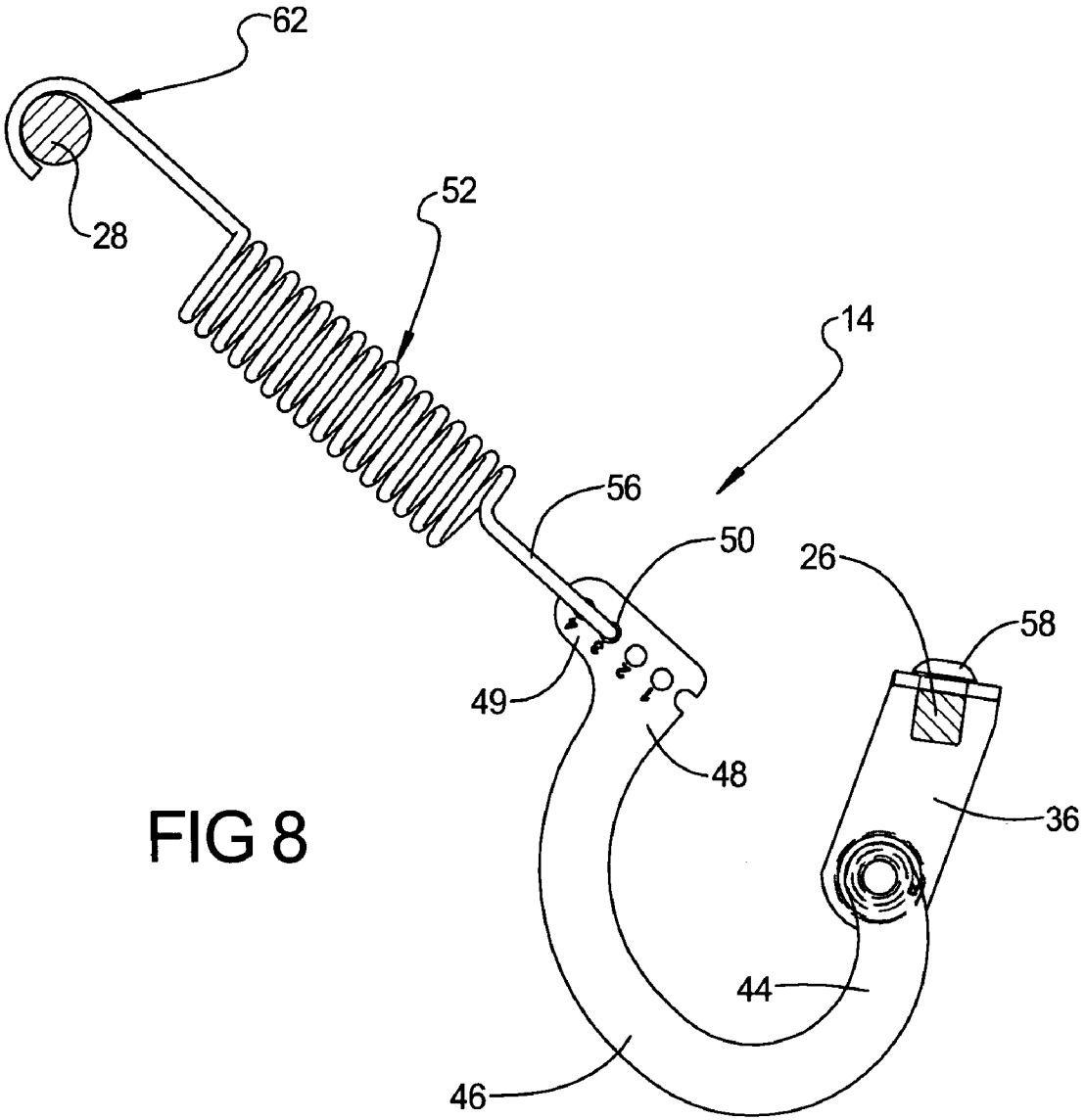
FIG. 8 is a side elevational view of the spring toggle assembly of FIG. 6 in an extended position.
Figure 9:
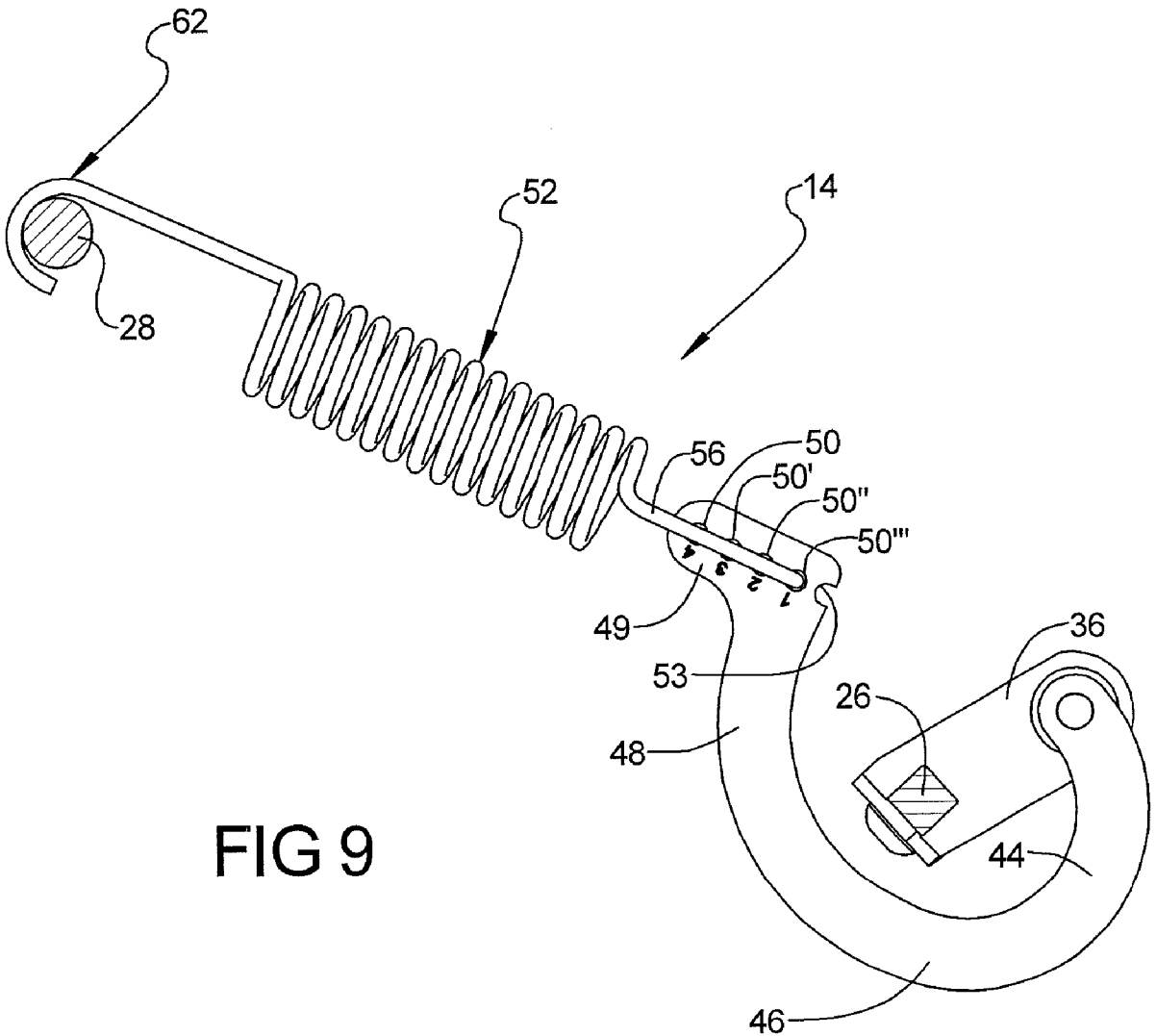
FIG. 9 is a side elevational view similar to FIG. 7, showing an alternate location for connecting the biasing element to the toggle.

Now with reference to FIGS. 7, 8 and 9, differences between the stowed and retracted positions of the leg rest assembly 16 are illustrated as well as differences provided by application of the plurality of apertures 50 of adjustable toggle link 46. First, adjustable toggle link 46 is shown as it rotates about drive rod 26 from the retracted position (see FIG. 7) to the extended position (see FIG. 8). In the retracted position, about half of C-shaped adjustable toggle link 46 is shown on the side of the drive rod 26 opposite that of biasing element 52, whereas in the extended position substantially all of C-shaped adjustable toggle link 46 is on the same side of the drive rod 26 as biasing element 52. Thus, biasing element 52 is stretched less in the extended position than in the retracted position. Accordingly, the biasing force developed by the biasing element in the retracted position exceeds the biasing force developed in the extended position. However, in another embodiment the extended biasing force exceeds the retracted biasing force.

With particular reference to FIG. 9, attachment element 56 is moved from the position shown in FIG. 7 to an alternate engagement position within aperture 50'''. As will be evident, engaging attachment element 56 with each successive aperture from 50 to 50''' incrementally increases the spring force or tension provided by biasing element 52, which increases the spring tension tending to hold leg rest 12 in either the stowed or extended position. This engagement selection allows a single biasing element 52 in conjunction with adjustable toggle link 46 to function with a plurality of furniture member designs. This aperture engagement selection is anticipated to be made during manufacture of the furniture member, but can also be made at a later time, by a repair person, or potentially by the user. Each aperture 50-50''' is identified by a number (i.e.: 4, 3, 2, 1) stamped or otherwise provided on adjustable toggle link 46. These numbers provide a visual reference for an installer of biasing element 52 to engage attachment element 56 in a pre-determined one of apertures 50-50'''. A semi-spherical aperture 53 is also provided with adjustable toggle link 46. Engaging attachment element 56 with semi-spherical aperture 53 maximizes the spring force or tension provided by biasing element 52. Use of semi-spherical aperture 53 provides a temporary position for attachment element 56 which can be used, for example, during repair or maintenance of mechanism 11 or furniture member 10, to more positively retain leg rest 12 in the extended position.

From a comparison of FIGS. 7-9, it can be seen that toggle assembly 14 and in particular toggle lever 36 rotates through about 145° of rotation from the retracted position to the extended position and crosses the over-center position after about 50° of rotation. In this manner, the kinematics of toggle assembly 14 is timed to provide a force balanced through the range of motion (i.e., retraction to extension and visa versa) which results in a smoothly operating leg rest assembly 16.

With continuing reference to FIGS. 6-9, biasing element 52 with engagement member 54 slidably engaged on support shaft 28 is also illustrated. In particular, a portion 60 of support shaft 28 is shown in FIG. 6. A shaped portion 62 of biasing element 52 is shown in this aspect as a hook. Portion 60 is generally free from obstructions, which would otherwise prevent shaped portion 62 of engagement member 54 from sliding along portion 60. Generally, portion 60 is located on support shaft 28 opposite the location of fastener 58 on drive rod 26.

Accordingly, biasing element 52 acting in tension will tend to pull engagement member 54 toward the center of portion 60. Thus, engagement member 54 of biasing element 52 will slide along the length of support shaft 28 and align itself between the drive rod 26 and the support shaft 28 where the biasing element 52 is at a minimum installed length. In other words, biasing element 52 can be deemed a self-aligning member of actuation mechanism 11. An anti-friction agent such as wax or oil may be provided locally on portion 60 of support shaft 28 to promote self-alignment. Because of the self-alignment of biasing element 52, biasing element 52 will experience a lower, and more predictable, level of cyclic stress during operation. Accordingly, biasing element 52 (and similarly stressed components) will last longer than non self-aligning biasing elements that experience a similar stress environment. The single biasing element 52 is generally sized to provide the desired biasing forces without requiring a second or subsequent biasing elements.

By way of comparison, known devices typically use one or more wires, spacers, biasing elements, retaining clips, and the like to maintain multiple biasing element toggles in alignment with the other components of furniture member 10. Thus, movement of known biasing element toggles causes all of these various components to move and vibrate. Accordingly, operation of known recliners produces more noise than furniture member 10 of the present invention. In contrast, the single biasing element toggle assembly 14 provided by the present invention requires no aids to align the single biasing element toggle assembly 14. Therefore, the present invention provides quieter operation. Additionally, by eliminating the alignment aids and reducing the number of biasing element toggles to one (and only one adjustable toggle in a preferred embodiment) the present invention significantly reduces the part count and therefore increases reliability of furniture member 10. Thus, furniture member 10 is simpler, lighter, less expensive, and more reliable than the known recliners.

Turning now to a detailed discussion of the load points of biasing element 52, those skilled in the art will appreciate that the upholstery and padding applied to the leg rest assembly 16 may cause relatively minor forces to act on the actuation mechanism 11. As previously described, some of these forces will tend to move the leg rest assembly 16 toward either the retracted or the extended positions (i.e.: "drop" and "drift"). Thus, it should be noted herein that the term biasing force refers to the force developed specifically by the biasing element 52 unless expressly stated otherwise.

With regard to the load points of the biasing element 52, it has been found that occupants of furniture member 10 prefer an actuation mechanism 11 that they perceive as operating smoothly (e.g., without sudden acceleration or jerks of the leg rest assembly 16). Thus, in one preferred embodiment, biasing element 52 is 5.8 inches long in a completely neutral state has a spring rate of 30 pounds per inch and an initial pre load of 17 pounds. Additionally, biasing element 52 may be placed relative to drive rod 26 and support shaft 28, to elongate the biasing element by about 7.75 inches in the extended position. Thus, one preferred extended spring force is approximately 83 pounds. In the retracted position biasing element 52 may likewise be elongated about 7.0 inches to provide a spring force of approximately 54 pounds. In one preferred embodiment, biasing element 52 is designed for a maximum extension of 8.5 inches.

In the over-center position (relative to the drive rod axis) biasing element 52 may be preloaded to about 17 pounds. Note that in one embodiment the over-center position corresponds to about a 67% extension of leg rest assembly 16. Thus, when biasing element 52 is over-center, the preload tends to act through the axis of drive rod 26 thereby tending to prevent movement of leg rest assembly 16 in either direction. As drive rod 26 rotates from the over-center point, it causes the spring force to act on the end of toggle lever 36 in a short moment arm (i.e., distance perpendicular to the spring force) from the axis of drive rod 26. Accordingly, the moment applied to drive rod 26 by biasing element 52 is relatively small near the over-center position due to the relatively short moment arm. As drive rod 26 continues to rotate, the moment arm increases in proportion to the sine of the increasing drive rod 26 angle from the over-center position. Therefore, biasing element 52 smoothly develops an increasingly larger biasing force as drive rod 26 rotates toward either the extended or retracted positions.

With reference now to FIGS. 10-13, elements of an adjustable stop member of actuation mechanism 11 are shown. A bracket 64 preferably of a metal material includes a connecting wall 66 integrally joined to a substantially U-shaped support wall 68. One or more apertures 70 are created in connecting wall 66, and a single aperture 72 is created in support wall 68. Bracket 64 forms part of a stop member assembly 74. Stop member assembly 74 further includes a stop member 76 of a semi-rigid material including polymeric materials such as nylon or a high durometer rubber material. Stop member 76 is connected to a post 78 which is slidably received in single aperture 72 of support wall 68. Post 78 is preferably metal and threaded substantially over its entire length. Post 78 receives at least one nut 80 opposite to (as viewed in FIG. 10) stop member 76. A second nut 81 (not visible in this view) can also be positioned proximate to stop member 76 to act as a double locking nut with nut 80. The use of one or more nuts 80,81 permit stop member 76 to be adjustably positioned. A washer 82 can also be used for each nut 80,81. In another aspect, single aperture 72 is threaded to receive post 78 and a single locking nut is used.

With particular reference to FIGS. 12-13, stop member assembly 74 is fastenably connected to front rail assembly 20. A spacer block 84 can also be used. Fasteners 86 positioned through front rail assembly 20 and spacer block 84 engage connecting wall 66 through apertures 70. Fasteners 86 can be threaded fasteners, rivets, bolts and the like.

Figure 5:
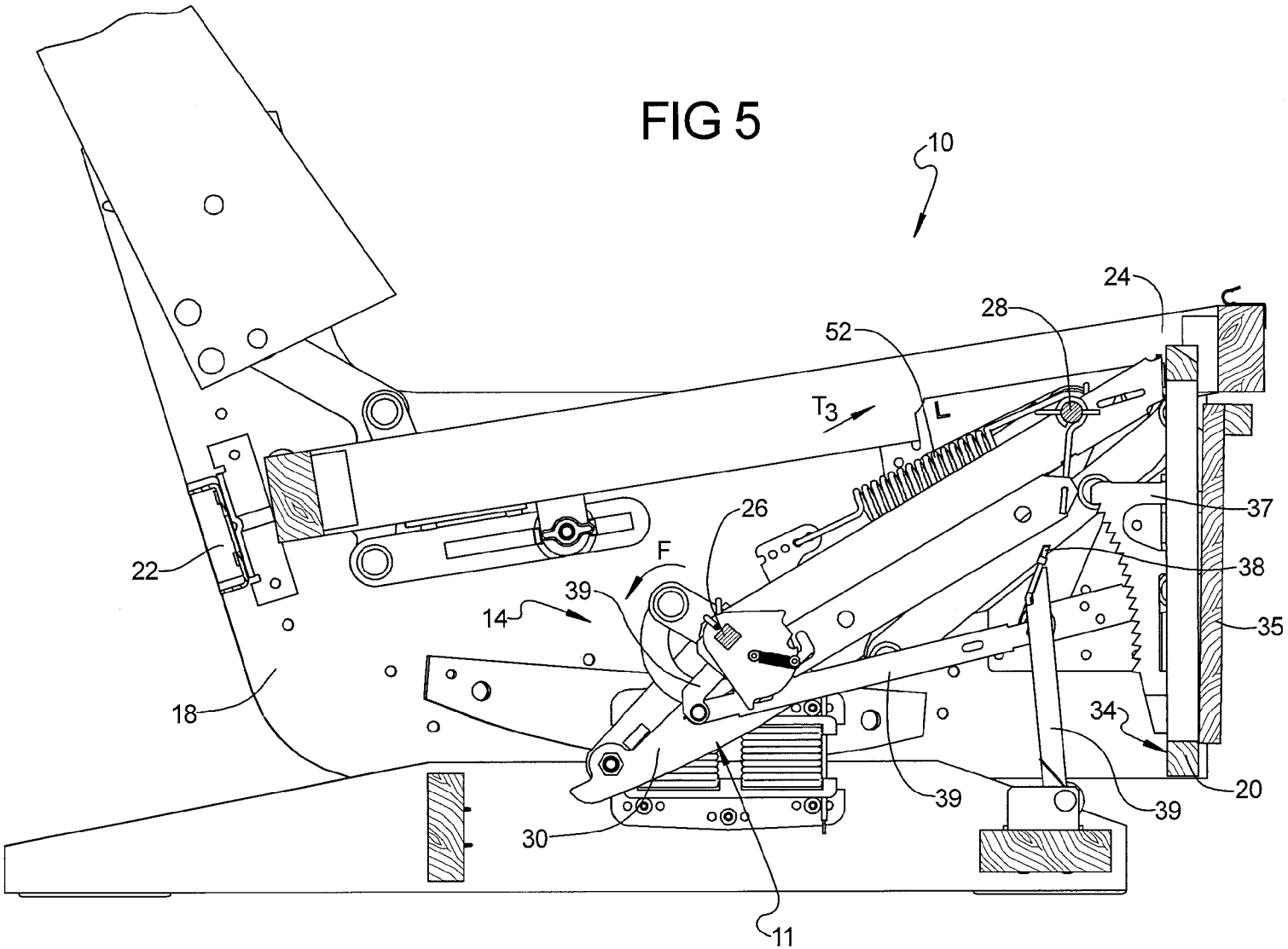
FIG. 5 is a cross sectional side elevational view taken at section 5-5 of FIG. 3.
Figure 14:
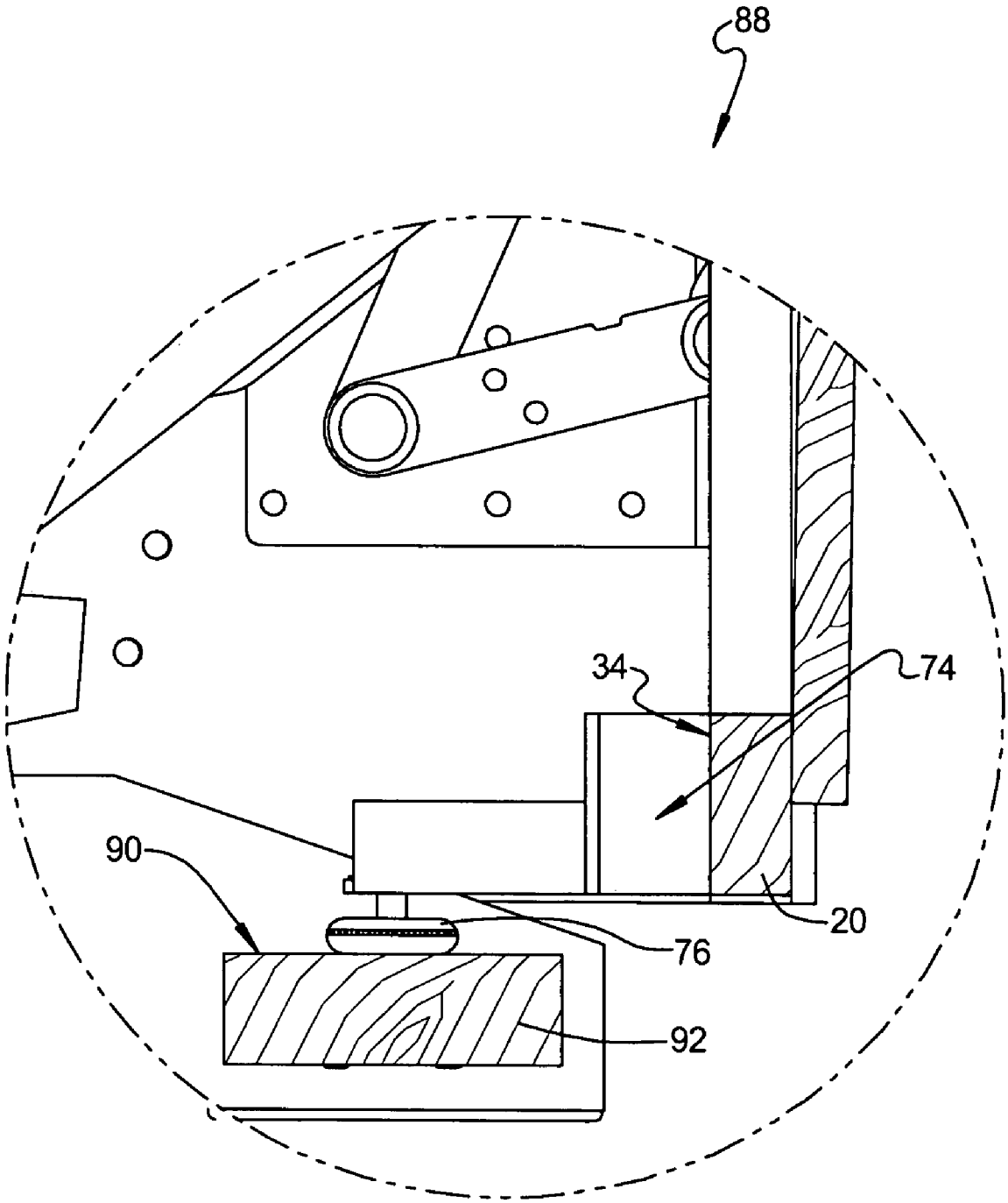
FIG. 14 is a partial sectional elevational view taken at area 14 of FIG. 4 showing an installed adjustable stop assembly of FIG. 12.

Referring generally now to FIG. 14, for a non-rocking furniture member 88, a view similar to FIG. 5 having the ratchet 37, pawl 38, and linkage assembly 39 removed and replaced by stop member assembly 74 is shown. When connected to inner surface 34 of front rail assembly 20, the stop member 76 of stop member assembly 74 abuts an upper surface 90 of a support frame member 92 of furniture member 88 when leg rest 12 is positioned in the down or stowed position. Stop member 76 therefore provides a positive stop point to prevent further motion of both leg rest 12 and actuation mechanism 11 and is particularly functional in non-rocking furniture members where motion of the mechanism or leg rest is undesirable in the stowed position. Spring tension of biasing element 52 is adjustable in this embodiment to prevent drift away from the positive stop point.

While several preferred embodiments have been described with particularity of the biasing element's parameters and force generation, one skilled in the art will recognize that the specification of a given toggle assembly are dictated by the parameters of a given chair. For example, the spring rates may be increased to accommodate a chaise-type leg rest mechanism that tends to be heavier than non-chaise-type leg rest. Likewise, the kinematics of the toggle assembly may be such that the moment arm at the extended position ($I_e$) and at the retracted position ($I_r$) provide a different force balance, thereby requiring modification of the biasing element parameters.

Moreover, because biasing element 52 is loaded at all times (even at the over-center point,) biasing element 52 tends to draw the drive rod 26, the support shaft 28, and the components of the spring toggle assembly 14 firmly together. Thus, biasing element pre-load reduces relative movement and backlash between these components. Accordingly, the present invention provides a quieter, smoother actuation mechanism 11 than known devices. Note should also be made, that for a given article of furniture member 10, the biasing forces and preload (discussed below) may be determined empirically.

In another embodiment, the engagement member 54 includes a hook to slidably engage the support shaft 28. While engagement member 54 with a diameter d1 equal to a diameter d2 of the support shaft 28 may be employed, a diameter d1 exceeding the diameter d2 is preferred. More particularly, it has been found that engagement members 54 having diameter d1 equal to diameter d2 tend to fail at shaped portion 62 of the biasing element 52 adjacent the engagement member 54 (i.e., adjacent the support shaft 28). In contrast, engagement members 54 with diameters d1 larger than d2 provide reliable and predictable service life when exposed to the designed level of cyclic stress. A diameter d1 between about 30% and about 70% of the diameter d2 is desirable. As presently preferred, a hook having a diameter of ¾ inches is used over a support shaft having a diameter of ½ inches.

An adjustable toggle and stop for a furniture member of the present invention offers several advantages. The multiple apertures of the toggle permit a biasing member such as a spring to be pre-loaded in incremental steps. This permits a single biasing member to be used for multiple mechanism applications where the weight of the leg rest or material stretch varies. It also permits the spring force of a single biasing member to be adjusted for example to accommodate the differences in weight of different occupants or for maintenance of the mechanism. This helps maintain the leg rest in its fully extended position. The stop assembly provides a positive stop feature which prevents the mechanism/furniture member from rocking or moving in the stowed position.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An article of furniture having an actuation mechanism for enabling a leg rest assembly to move between a stowed position and an extended position, the mechanism including a support shaft and a drive rod spaced apart from the support shaft, the article of furniture comprising:

a toggle link coupled to the drive rod, the toggle link having a plurality of apertures co-axially aligned with each other;

a biasing element with a first end attached to one of the plurality of apertures of the toggle link and a second end slidably engaging the support shaft;

wherein a spring force of the biasing element is operably variable when the first end of the biasing element is attached to different ones of the plurality of apertures to maintain a leg rest assembly in a stowed position and in an extended position.

2. The article of furniture according to claim 1, further comprising a member formed at the second end, the member having an inner diameter larger than a diameter of the support shaft; the second end being slidable along the support shaft to align the biasing element thereon.

3. The article of furniture according to claim 2, wherein each of the first end and the member further comprise a hook.

4. The article of furniture according to claim 1, wherein the biasing element is a helical coil spring sized to provide all of an extended biasing force to retain the leg rest assembly in the extended position.

5. The article of furniture according to claim 4, wherein the biasing element is sized to provide all of a stowed biasing force to retain the leg rest assembly in the stowed position.

6. The article of furniture according to claim 5, further comprising a stop member assembly operable to create a positive stop point for the leg rest assembly in the stowed position.

7. The article of furniture according to claim 6, further comprising:

a stop member connected for threaded adjustment to the stop member assembly; and a frame member of the article of furniture;

wherein the stop member operably abuts the frame member in the stowed position.

8. The article of furniture according to claim 5, wherein the biasing element is positioned relative to the support shaft so that the stowed biasing force is less than the extended biasing force.

9. The article of furniture according to claim 1, wherein the toggle link further comprises an extended arm having the plurality of apertures positioned on the extended arm.

10. The article of furniture according to claim 1, wherein the spring force of the biasing element is further operably variable to balance a plurality of forces acting on the article of furniture, the plurality of forces including:

a leg rest assembly weight induced force;

a first tension force created by a seat material covering; and a second tension force created by a plurality of straps operable to mount a seat cushion.

11. The article of furniture according to claim 1, further comprising a ratchet device operable to position the leg rest assembly in a plurality of stepped positions between the stowed and extended positions; wherein the spring force of the biasing element is further operably variable to maintain the leg rest assembly in any of the plurality of stepped positions for each of a weight loaded and a weight unloaded condition of the leg rest assembly.

12. An article of furniture of the type having a seat assembly supported from a chair frame and an actuation mechanism for enabling a leg rest assembly to move between a stowed position and an extended position, the article of furniture comprising:

a support shaft;

a drive rod spaced apart from the support shaft;

a toggle link coupled to the drive rod, the toggle link including an extending portion having a plurality of aligned apertures created in the extending portion which is oriented substantially perpendicular to an axis of the drive rod; and a biasing assembly including a single biasing element with a first end attached to a select one of the plurality of apertures of the toggle link and a second end engaging the support shaft, the second end being slidable along an axis defined by the support shaft to self-align the biasing element thereon.

13. The article of furniture according to claim 12, further comprising a member formed on the second end, the member having an inner diameter larger than a diameter of the support shaft, whereby stress on a portion of the biasing element assembly adjacent the support shaft is reduced.

14. The article of furniture according to claim 13, wherein the member further comprises a hook.

15. The article of furniture according to claim 12, wherein the single biasing element is sized to provide all of a stowed biasing force to retain the leg rest assembly in the stowed position the single biasing element operably the leg rest assembly in the stowed position.

16. The article of furniture according to claim 15, wherein the single biasing element is positioned relative to the support shaft so that the stowed biasing force is less than an extended biasing force of the single biasing element when the leg rest assembly is in the extended position.

17. The article of furniture according to claim 16 wherein the single biasing element is a single coiled spring.

18. The article of furniture according to claim 12, wherein the drive rod comprises a substantially rectangular shape.

19. The article of furniture according to claim 18, further comprising:

a toggle lever operable to connect the toggle link to the drive rod;

wherein the drive rod is operably received through a rectangular-shaped aperture created in the toggle lever.

20. The article of furniture according to claim 12, wherein the support shaft further comprises a shaft portion including a smooth surface, wherein the second end slidably engages the smooth surface to operably assist self-alignment of the biasing element.

21. In an article of furniture of the type having a seat assembly supported from a chair frame and an actuation mechanism for enabling a leg rest assembly to move between a stowed position and an extended position, the mechanism comprising:

a support shaft;

a drive rod spaced apart from the support shaft;

a toggle link coupled to the drive rod, the toggle link including an extending portion having a plurality of aligned apertures created therethrough; and a biasing assembly including a single biasing element with a first end attached to a select one of the plurality of apertures of the toggle link and a second end engaging the support shaft, the second end being slidable along an axis defined by the support shaft to self-align the biasing element thereon;

wherein proximate to one of the aligned apertures is a semispherical notch positioned to provide a maximum spring tension of the biasing element, the semispherical notch selectable to maintain the leg rest assembly in the extended position.

22. A method for assembling an article of furniture of the type having a seat assembly supported from a frame and an actuation mechanism for enabling a leg rest assembly to move between a stowed position and an extended position, the actuation mechanism including a support shaft, a drive rod spaced apart from the support shaft, a biasing element connected to both the support shaft and the drive rod, and a toggle link coupled to the drive rod, the toggle link having a plurality of aligned apertures, the method comprising:

connecting a first end of the biasing element to one of the plurality of aligned apertures of the toggle link;

engaging a second end of the biasing element to the support shaft whereby the second end is slidable along an axis defined by the support shaft to operably align the biasing element; and moving the first end of the biasing element to a different one of the plurality of aligned apertures which are all coaxially aligned on an arm of the toggle link oriented substantially perpendicular to an axis of the drive rod in an over center condition of the toggle link to operably change a preload spring tension of the biasing element.

23. The method according to claim 22, further comprising reducing stress on a portion of the biasing assembly adjacent the support shaft by sizing an inner diameter of the second end to be larger than a diameter of the support shaft.

24. The method according to claim 23, further comprising shaping the second end in a hook shape.

25. The method according to claim 22, further comprising sizing the biasing element to provide all of a stowed biasing force to retain the leg rest assembly in the stowed position when the leg rest is in the stowed position, whereby the biasing element biases the leg rest assembly in the stowed position.

26. The method according to claim 25, further comprising positioning the biasing element relative to the support shaft so that the stowed biasing force is less than the extended biasing force.

27. The method according to claim 22, further comprising sizing the biasing element to provide all of an extended biasing force to retain the leg rest assembly in the extended position when the leg rest is in the extended position, whereby the biasing element biases the leg rest assembly in the extended position.

28. The method according to claim 22, further comprising slidably engaging the second end of the biasing element with a smooth shaft portion of the support shaft.

29. A method for assembling an article of furniture of the type having a seat assembly supported from a frame and an actuation mechanism for enabling a leg rest assembly to move between a stowed position and an extended position, the actuation mechanism including a support shaft, a drive rod spaced apart from the support shaft, a biasing element connected to both the support shaft and the drive rod, and a toggle link coupled to the drive rod, the toggle link having a plurality of aligned apertures, the method comprising:

connecting a first end of the biasing element to one of the plurality of apertures of the toggle link;

engaging a second end of the biasing element to the support shaft whereby the second end is slidable along an axis defined by the support shaft to operably align the biasing element thereon; and connecting the first end of the biasing element to a semi-spherical shaped notch of the toggle link to maximize a preload spring tension of the biasing element.

* * * * *

UNITED STATES PATENT AND TRADEMARK OFFICE

CERTIFICATE OF CORRECTION

PATENT NO. : 7,431,387 B2
APPLICATION NO. : 11/111124
DATED : October 7, 2008
INVENTOR(S) : Larry P. LaPointe et al.

It is certified that error appears in the above-identified patent and that said Letters Patent is hereby corrected as shown below:

Column 8, Line 34;
After "state", insert -- , --;

Column 8, Line 55, Claim 15;
After "operably", insert -- biasing --;

Column 12, Line 45, Claim 22;
After "element", insert -- thereon --.

Signed and Sealed this

Seventeenth Day of February, 2009

JOHN DOLL
*Acting Director of the United States Patent and Trademark Office*